US007918576B2

(12) United States Patent
Leanza

(10) Patent No.: US 7,918,576 B2
(45) Date of Patent: Apr. 5, 2011

(54) ILLUMINATED CLIPBOARD WITH REMOVABLE LIGHT SOURCE

(76) Inventor: Anthony S. Leanza, Olmsted Township, OH (US)

( * ) Notice: Subject to any disclaimer, the term of this patent is extended or adjusted under 35 U.S.C. 154(b) by 471 days.

(21) Appl. No.: 11/809,311

(22) Filed: May 31, 2007

(65) Prior Publication Data

US 2008/0298047 A1 Dec. 4, 2008

(51) Int. Cl.
*F21V 33/00* (2006.01)

(52) U.S. Cl. ..... 362/99; 362/98; 362/230; 362/231; 362/249.02

(58) Field of Classification Search ..... 362/98, 362/99, 230, 231, 251, 249.02; 40/124.02, 40/627

See application file for complete search history.

(56) References Cited

U.S. PATENT DOCUMENTS

| | | | | | |
|---|---|---|---|---|---|
| 1,456,927 | A * | 5/1923 | Kumpf | 362/99 |
| 2,395,760 | A * | 2/1946 | Quan | 362/99 |
| 2,658,989 | A * | 11/1953 | Marschat | 362/99 |
| 2,806,715 | A * | 9/1957 | Smith | 362/99 |
| 3,297,862 | A * | 1/1967 | Levy et al. | 362/99 |
| 3,309,514 | A * | 3/1967 | Levy et al. | 362/99 |
| 3,977,744 | A | 8/1976 | DeWitt | |
| 4,577,788 | A * | 3/1986 | Richardson | 224/483 |
| 4,751,620 | A * | 6/1988 | Wright et al. | 362/99 |
| 4,892,334 | A * | 1/1990 | Sinclair | 281/45 |
| 5,115,893 | A | 5/1992 | Terkildsen | |
| 5,176,438 | A * | 1/1993 | Fisherman | 362/99 |
| 5,829,787 | A | 11/1998 | Newhouse, Jr. | |
| 6,666,563 | B2 | 12/2003 | Brown | |
| 6,846,090 | B1 * | 1/2005 | Smith | 362/99 |
| 2003/0029985 | A1 * | 2/2003 | Zeller et al. | 248/461 |
| 2006/0139909 | A1 | 6/2006 | Leanza | |

* cited by examiner

*Primary Examiner* — Ismael Negron

(57) ABSTRACT

An illuminated clipboard is provided including a base member having an outer surface with a first lamp retainer and a storage compartment with a second lamp retainer. A document holder is secured to the base member for holding a document. An illumination source is removably attachable to the first lamp retainer to selectively illuminate a document held by the document holder and attachable to the second lamp retainer for storage in the storage compartment. A second clipboard can be removable attached to the illuminated clipboard in a back-to-back relationship.

19 Claims, 4 Drawing Sheets

ILLUMINATED CLIPBOARD WITH REMOVABLE LIGHT SOURCE

TECHNICAL FIELD

The present invention is directed to a clipboard and, more particularly, to an illuminated clipboard that can be used for assisting in preparation of accident reports and also combined with an illuminated ticket writing board to assist a police officer in writing a traffic accident report and/or issuing a traffic ticket.

BACKGROUND OF THE INVENTION

Clipboards are used for many different applications such as securely holding papers and providing a user with a portable and convenient writing surface. Because of their portability, clipboards are often used in an environment that is not otherwise conducive to writing on paper. For instance, police officers normally use a clipboard as an aid to issue traffic tickets at the site of a traffic stop. Traffic tickets may be issued at night when it is difficult for the issuing officer to efficiently fill out the ticket form using a traditional clipboard. It is hard for a police officer to view a driver's license and copy driver's information to a ticket form in a dark environment without returning to his vehicle. Though officers normally carry a flashlight, it is awkward for the officer to hold the flashlight while simultaneously holding the clipboard, writing, and reading the small print on the driver's license.

Co-pending U.S. Application No. 2006/0139909, to Leanza entitled "Illuminated Clipboard and Method of Use," filed Dec. 15, 2005, is hereby fully incorporated herein by reference. This Leanza co-pending application is directed to an improved illuminated clipboard for police officers to aid a police officer in writing traffic tickets including writing traffic tickets at night. The clipboard includes an illuminated license holding area and an illuminated ticket writing area.

In addition to issuing traffic tickets, a police office is often required to fill out accident reports as a result of a traffic accident. Such accidents may occur at night making the writing of such reports difficult without the need to return to the officer's vehicle or use of a flashlight. The filling out of an accident report may also be coincident with the issuance of a traffic ticket since one of the parties involved in the accident may have violated a traffic law that resulted in the accident.

SUMMARY OF THE INVENTION

In an example embodiment of the present invention, an illuminated clipboard is provided comprising a base member having an outer surface with a first lamp retainer and a storage compartment with a second lamp retainer. A document holder is secured to the base member for holding a document. An illumination source is removably attachable to the first lamp retainer to selectively illuminate a document held by the document holder and is attachable to the second lamp retainer for storage in the storage compartment.

In another example embodiment of the present invention, an illuminated clipboard is provided comprising a base member having an outer surface, the outer surface including a retaining means and a document holding device located on the outer surface of the base member. The clipboard further includes a rigid illumination source adapted to selectively illuminate a document held by the document holding device, the rigid illumination source having receiving means, the receiving means being releasably engageable with the retaining means to secure the rigid illumination source to the outer surface of the base member.

In yet another example embodiment of the present invention, an illuminated clipboard comprises a base member having an outer surface and a storage compartment, the outer surface including lamp mounting posts, the storage compartment including a lamp storage holder, and a document holding device located on the outer surface of the base member. A first attachment device is located on the outer surface of the base member. The illuminated clipboard further includes a lamp adapted to selectively illuminate a document held by the document holding device, the lamp having receiving means, the receiving means being releasably engageable with the lamp mounting posts to releasably secure the lamp to the outer surface of the base member, the lamp also being securable by the lamp storage holder when in the storage compartment, and a second clipboard having an outer surface, said outer surface of said second clipboard including second attachment device so that the illuminated clipboard and the second clipboard can be releasably attached together.

In yet accordance with another example embodiment of the present invention, a clipboard assembly is provided comprising a first clipboard having a storage compartment, a second clipboard, and means for releasably securing the first clipboard and the second clipboard together in an operative back-to-back relationship.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DETAILED DESCRIPTION

Figure 1:
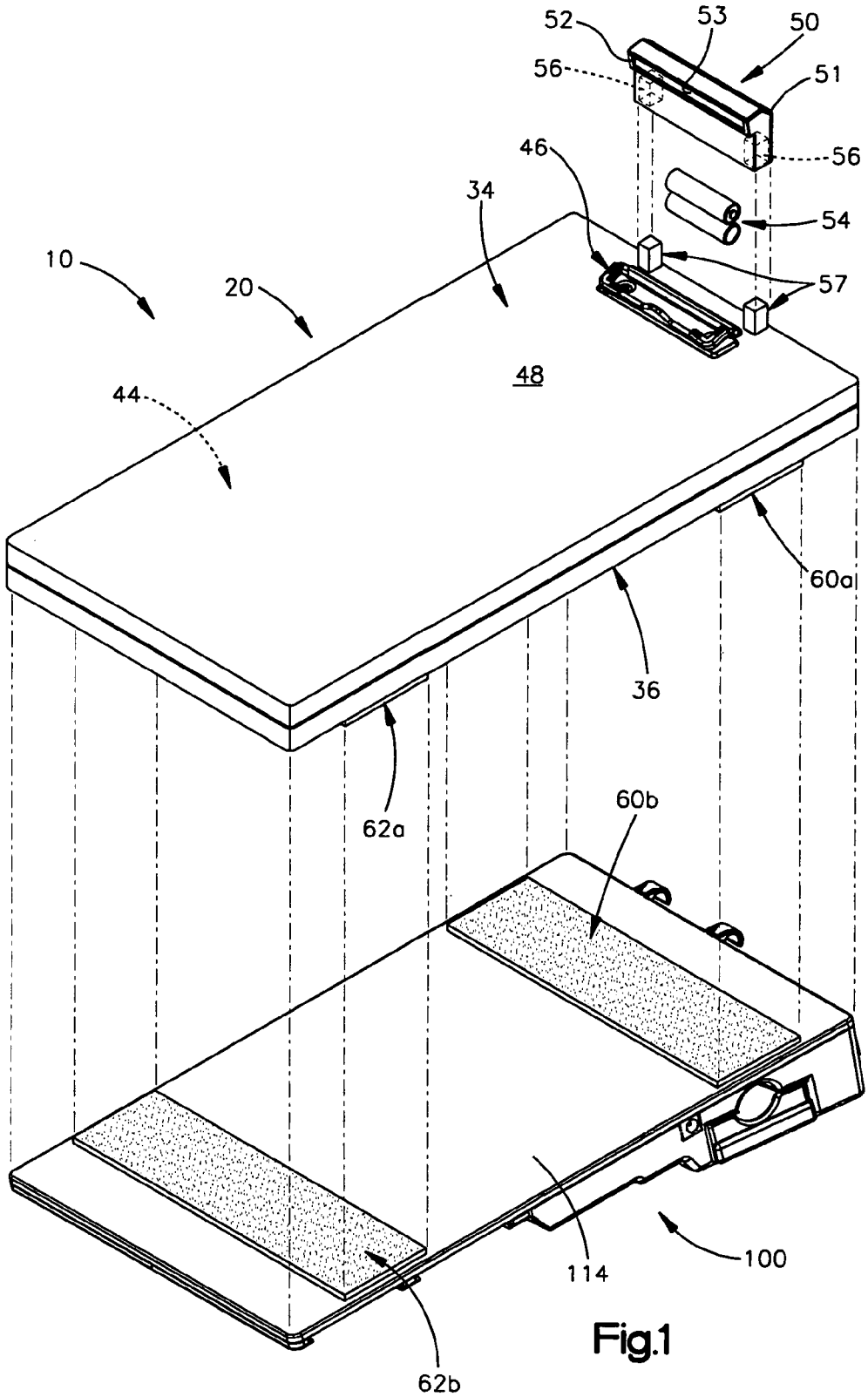
FIG. 1 is an exploded side perspective view of an illuminated reporting clipboard and an illuminated police ticket clipboard in accordance with one example embodiment of the present invention.

Referring to FIG. 1, an illuminated clipboard assembly 10, in accordance with one example embodiment of the present invention, includes an illuminated reporting clipboard 20 and an illuminated police ticket clipboard 100.

Figure 2:
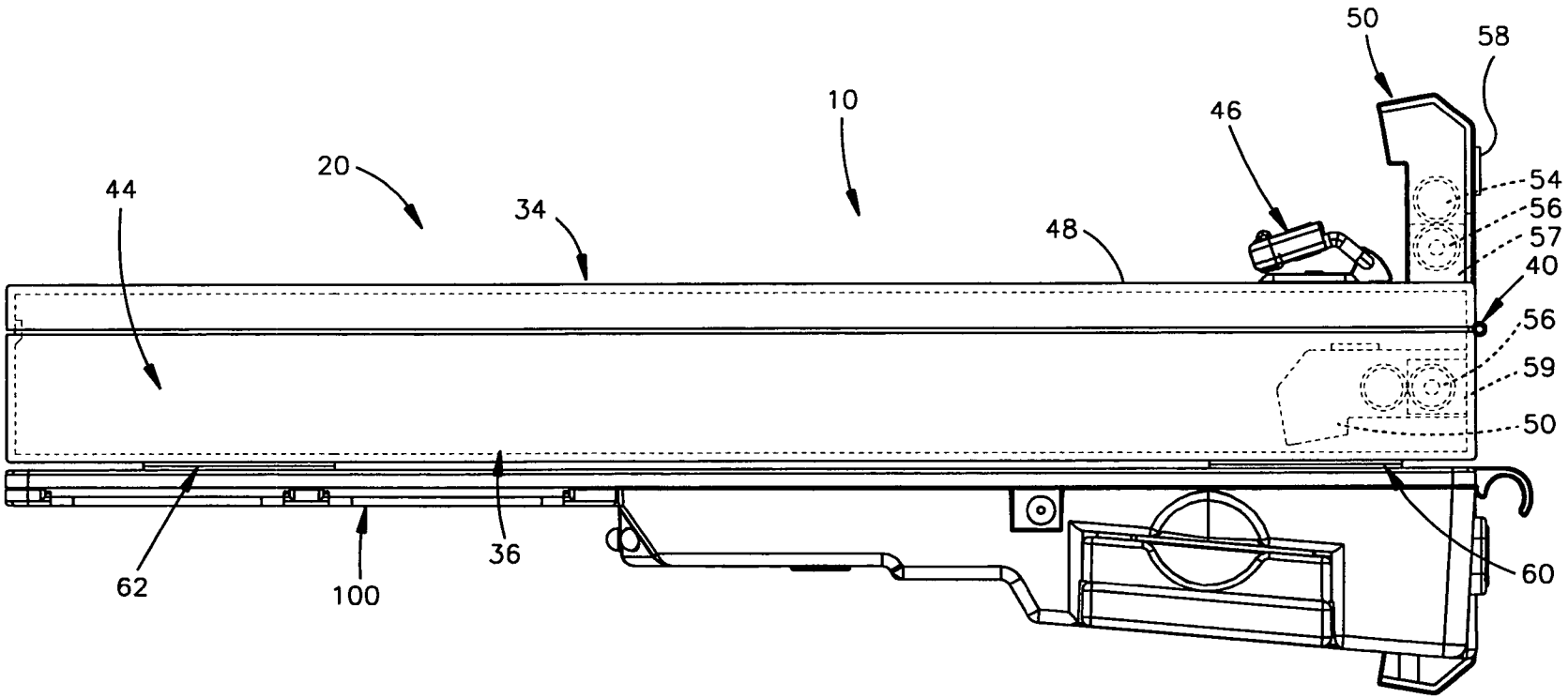
FIG. 2 is a side view of the illuminated reporting clipboard and the illuminated police ticket clipboard of FIG. 1 in a back-to-back operative relationship.
Figure 4:
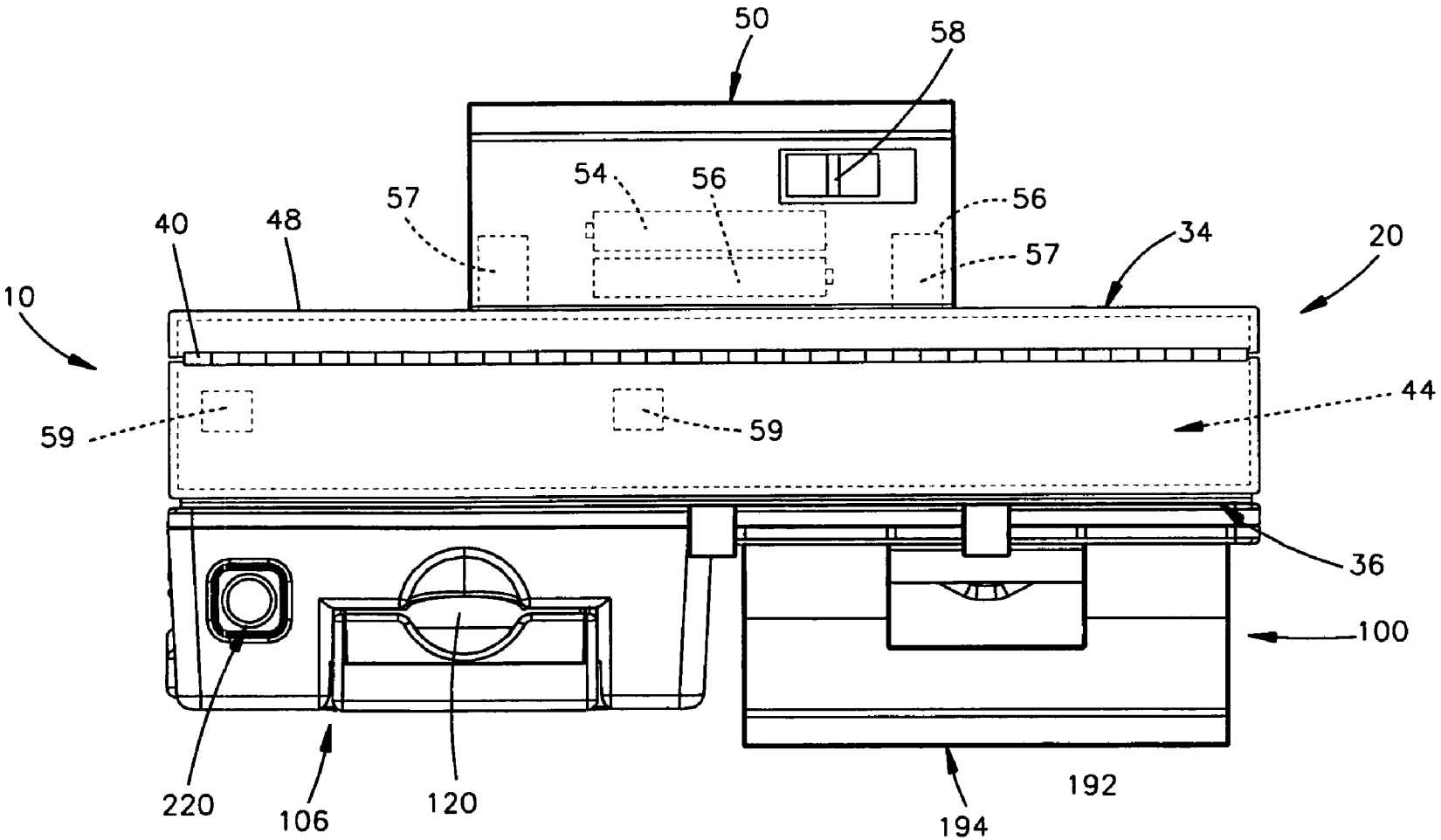
FIG. 4 is another side view of the illuminated reporting clipboard and the illuminated police ticket clipboard of FIG. 1 in a back-to-back operative relationship.

The illuminated reporting clipboard 20 includes a top portion 34 and a bottom portion 36 hinged together by a piano-type hinge 40 (See FIGS. 2 and 4). The top portion 34 and bottom portion 36 form an internal storage compartment 44 for storing documents such as blank accident reports or traffic tickets. The illuminated reporting clipboard 20 has a clamshell configuration in which the hinge 40 (FIGS. 2 and 4) connects the top portion 34 and the bottom portion 36, and allows the illuminated reporting clipboard 20 to open and close. The storage compartment 44 is defined by the space between the top portion 34 and bottom portion 36 and is accessible by opening the illuminated reporting clipboard 20 in the fashion described.

The illuminated reporting clipboard 20, in accordance with the shown and described example embodiment, is generally rectangular in shape, but could, alternatively, be any other desired shape, such as square. The illuminated reporting clipboard 20 may be made of any suitable material, including, but not limited to, plastic, wood, chipboard, cardboard, metal, or the like, or any combination thereof. A clasp (not shown) internal to the storage compartment 44 maintains the top portion 34 and bottom portion 36 normally closed. The clasp can be any known suitable friction type clasp. An internal seal (not shown) could also be provided to make the storage compartment 44 waterproof if desired.

A document receiving/holding device 46 is disposed or otherwise secured an outer surface 48 of the illuminated reporting clipboard 20, preferably near one end of the illuminated reporting clipboard 20 in the vicinity of the end of the board having the hinge 40. The document receiving/holding device 46 may include any means capable of holding a document (not shown) against the outer surface 48 of the illuminated reporting clipboard 20, such as a spring-loaded clip, a friction clip, an adhesive patch, a transparent cover, a set of posts adapted to mate with holes in the document, or the like. The document receiving/holding device 46 allows the user of the illuminated clipboard assembly 10, or the reporting clipboard 20 itself, to easily secure the document to the illuminated reporting clipboard 20 so as to subsequently write on the document as when filling out an accident report or any other document.

The illuminated clipboard assembly 10 further includes a removable illumination source 50 or lamp adapted to selectively illuminate the document received and held by the document receiving/holding device 46. The removable illumination source 50 comprises a rigid, rectangular, plastic housing 51 and a plurality of light emitting diodes ("LEDs") 52 disposed behind a glass or clear plastic cover 53 that is oriented to direct visible light onto the document. The removable illumination source 50 is a self-contained unit, i.e., rechargeable internal batteries 54 are provided in the plastic housing 51 of the removable illumination source 50 to supply necessary electrical power for operation of the LEDs. The removable illumination source 50 includes an ON and OFF switch 58 (See FIG. 4) for selectively controlling the illumination of the plurality of LEDs 52 with power of the rechargeable internal batteries 54.

The removable illumination source 50 further includes spaced apart receiving openings 56 that allow the removable illumination source 50 to be releasably mounted onto the illuminated reporting clipboard 20. The outer surface 48 of the illuminated reporting clipboard 20 includes spaced apart lamp mounting posts 57 shaped and spaced commensurate with the receiving openings 56 of the removable illumination source 50. The spaced apart lamp mounting posts 57 are integrally formed with, or otherwise secured to, the outer surface 48. The spaced apart lamp mounting posts 57 releasably engage the spaced apart receiving openings 56 of the removable illumination source 50 in a tight friction fit to secure the removable illumination source 50 to the outer surface 48 of the illuminated reporting clipboard 20. The spaced apart lamp mounting posts 57 may be rectangular in nature, as shown in the example embodiment, or any other suitable shape (i.e. cylindrical or square). The placement of the spaced apart lamp mounting posts 57 on the outer surface 48 of the illuminated reporting clipboard 20 is such that the removable illumination source 50, when engaged with the spaced apart lamp mounting posts 57, is capable of selectively illuminating the document held by the document receiving/holding device 46.

Located within the storage compartment 44 of the illuminated reporting clipboard 20, in accordance with an example embodiment of the present invention, is a lamp storage holder 59 to allow the removable illumination source 50 to be removed from the outer surface 48 of the illuminated reporting clipboard 20 and to be secured to the inside of the storage compartment 44 when not in use or needed (e.g., during daylight hours or when the illuminated reporting clipboard 20 is used in combination with another clipboard). The lamp storage holder 59 includes, in accordance with an example embodiment of the present invention, spaced apart lamp mounting posts identical to lamp mounting posts 57 such that the spaced apart receiving openings 56 of the removable illumination source 50 is capable of mating with both the spaced apart lamp mounting posts 57 and the lamp storage holder mounting posts 59. Thus, the lamp storage holder 59 comprises a plurality of projections or mounting posts having the same shape as the spaced apart lamp mounting posts 57 and being integrally formed with, or otherwise secured to an inside wall surface of the storage compartment 44.

Those skilled in the art will appreciate that any other shaped or type of holding device could be used inside of the storage compartment 44 to hold the removable illumination source 50 in place when in storage so as to retain it in a fixed, secured position when not in use such as a U-shaped clip, VELCRO®, i.e., hook and loop fasteners, or any other releasable fastener. Also, the location of the holding device or retaining device within the storage compartment 44 where the removable illumination source 50 is stored is not critical. It must simply be positioned and arranged to hold and orient the removable illumination source 50 so that the top portion 34 will close relative to the bottom portion 36 and be secured so as not to move around within the storage compartment 44.

A first multi-board attachment device 60 and a second multi-board attachment device 62 are provided to removably connect the illuminated reporting clipboard 20 to a second clipboard such as the illuminated police ticket clipboard 100. Specifically, the first multi-board attachment device 60 and the second multi-board attachment device 62 include, in accordance with one example embodiment of the present invention, VELCRO®, i.e., hook and loop fasteners, double-sided adhesive tape, or any other separable fastener suitable to provide a releasably attachable connection between the illuminated reporting clipboard 20 and the illuminated police ticket clipboard 100.

In accordance with one example embodiment of the present invention, the first multi-board attachment device 60 includes two parts 60*a* and 60*b*, being respectively attached to the illuminated reporting clipboard 20 and to the illuminated police ticket clipboard 100. The second multi-board attachment device 62 includes two parts 62*a* and 62*b*, being respectively attached to the illuminated reporting clipboard 20 and to the illuminated police ticket clipboard 100. The first multi-board attachment device 60 and the second multi-board attachment device 62 are, in accordance with the example embodiment, spaced apart to provide better attachment holdability between the two clipboards 20, 100. Those skilled in the art will appreciate that the two boards can be pulled apart and used separately if desired or attached together and used simultaneously. When the two boards 20, 100 are attached together for simultaneous use, it may be desired to remove the removable illumination source 50 and to store it inside the storage compartment 44. When used in combination, forms and supplies needed for board 100 can be stored in the storage compartment 44.

For illustrative purposes, FIG. 1 depicts a plurality of VELCRO®, i.e., hook and loop fasteners strips 60*a*, 62*a*, are secured to the outer surface on the bottom portion 36 of the illuminated reporting clipboard 20. Likewise, a plurality of Velcro® strips 60*b*, 62*b* are secured to the bottom outer surface 114 of the illuminated police ticket clipboard 100. Although two strips of VELCRO®, i.e., hook and loop fasteners are shown on both the illuminated reporting clipboard 20 and the illuminated police ticket clipboard 100, those skilled in the art will appreciate that any number of strips may be utilized to attach the illuminated reporting clipboard 20 to the illuminated police ticket clipboard 100. The placement of the first multi-board attachment device 60 and second multi-board attachment device 62 allow the illuminated reporting clipboard 20 to be releasably attached to the illuminated police ticket clipboard 100 to form the illuminated clipboard assembly 10. The first and second multi-board attachment devices 60, 62 could, for example, be placed such that the illuminated reporting clipboard 20 may be releasably attached to the illuminated police ticket clipboard 100 in a first orientation, or rotated 180 degrees and releasably attached to the illuminated police ticket clipboard 100 in a second orientation. The particular orientation utilized between the two boards 20, 100 will be determined by user preference. This attachment feature provides the user using the illuminated clipboard assembly 10 with multiple document surfaces as well as a storage compartment combined into one convenient assembly.

It is also contemplated that other attachment devices could be used such as side U-shaped clips, posts with grabbing receiving holes, or any other type of releasable holding arrangement that will allow the two clipboards to be repeatedly assembled together and pulled apart as desired.

FIG. 2 depicts the side view of the illuminated clipboard assembly 10 of FIG. 1 including the illuminated reporting clipboard 20 attached to the illuminated police ticket clipboard 100 in which the removable illumination source 50 has been secured to the spaced apart lamp mounting posts 57 on the outer surface 48 on the illuminated reporting clipboard 20.

When it is desired that the removable illumination source 50 be stored away so as not to be damaged (i.e. during daylight hours, when the user has finished using the illuminated clipboard assembly 10, or when the illuminated clipboard assembly 10 is otherwise not in use), the storage compartment 44 is accessed by opening the top portion 34 of the illuminated reporting clipboard 20 via the hinge 40. At this point, the spaced apart receiving openings 56 on the removable illumination source 50 are disengaged from the spaced apart lamp mounting posts 57 on the outer surface 48 of the illuminated reporting clipboard 20 (i.e., the illumination source 50 is pulled off of posts 57) and releasably engaged with the lamp storage holder 59 within the storage compartment 44 (i.e., the illumination source 50 is mounted on posts 59). This secures the removable illumination source 50 to the storage compartment 44. Once the illuminated reporting clipboard 20 is closed, the removable illumination source 50 is protected. The removable illumination source 50 can be returned to the document illumination position on the outside by reversing the steps above.

Figure 3:
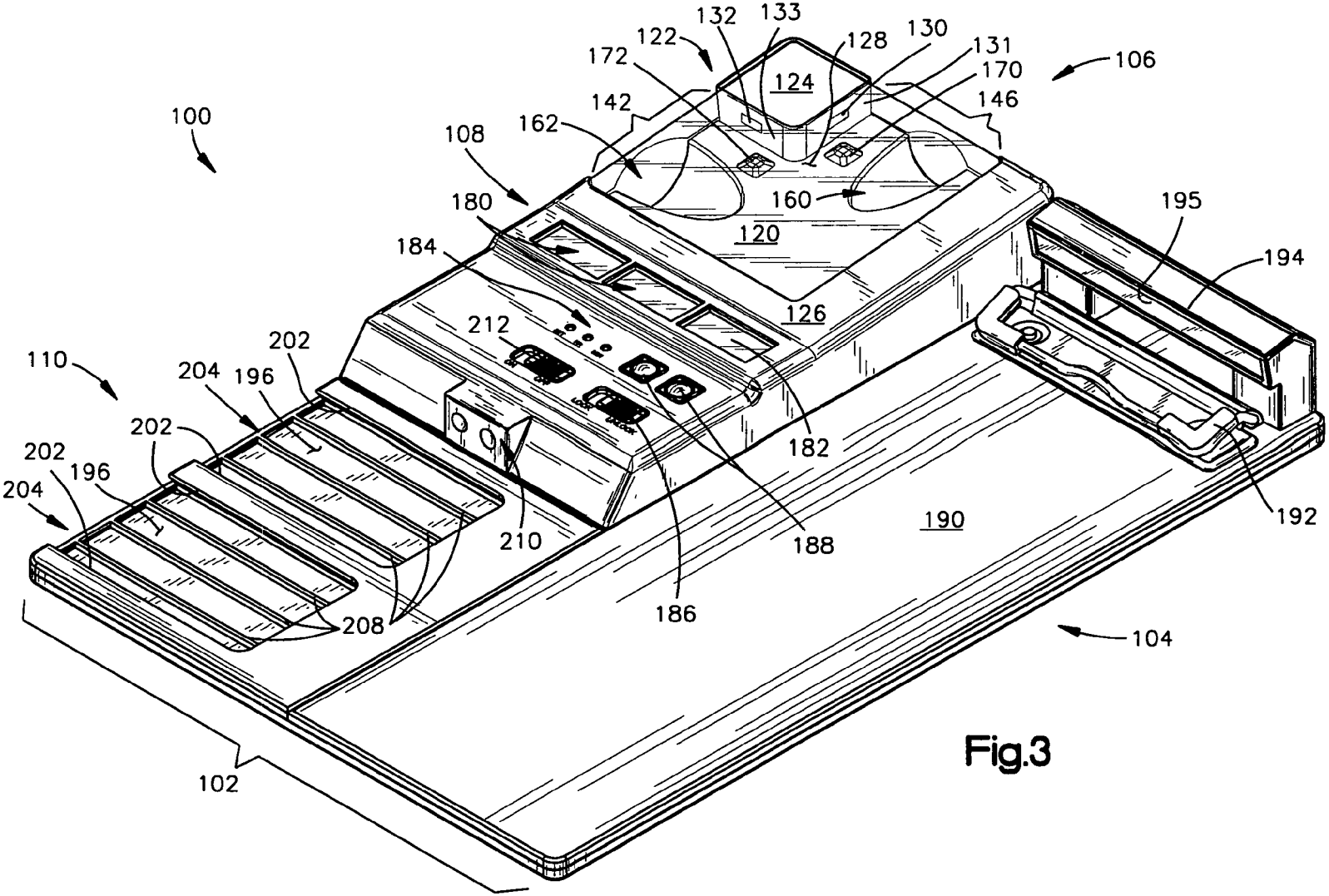
FIG. 3 is a perspective view of the illuminated police ticket clipboard shown in FIG. 1.

FIG. 3 depicts one example embodiment of the illuminated police ticket clipboard 100 of illumination clipboard assembly 10. Illuminated police ticket clipboard 100 includes a clipboard base 102 having an illuminated ticket-writing area 104, an illuminated license receiving/viewing device 106, a date, clock, and court date information area 108, and an illuminated supplemental license receiving/holding area 110. The illuminated police ticket clipboard 100 may be made in dimensions other than that specifically shown and described depending on the particular desired use of the clipboard. For the purpose of explanation, the illuminated police ticket clipboard 100 is described as a police clipboard to aid police officers in issuing traffic tickets. The position of elements 106, 108, and 110 of the illuminated police ticket clipboard 100 described herein may be positioned in locations other than that specifically shown, depending on the particular desired use of the clipboard. Those skilled in the art will appreciate that not all of the elements 106, 108, and 110 are required for a clipboard in accordance with the present invention. The illuminated police ticket clipboard 100 may be made from any suitable material, including, but not limited to plastic, wood, chipboard, cardboard, metal, and the like, or any combination of materials.

The illuminated license receiving/viewing device 106 of the illuminated police ticket clipboard 100 is located at one corner, e.g., upper left corner, of the clipboard base 102. The illuminated license receiving/viewing device 106 is also referred to herein as an information card receiving/viewing device. The license receiving/viewing device 106 is secured to or integrally formed as part of the clipboard base 102. The license receiving/viewing device 106 includes a bottom wall 120 of a recess 122 between surfaces 124 and 126. A lens 128 is received in the recess 122 and covers the bottom wall 120. In accordance with one example embodiment, lens 128 is a magnifying lens so that any item positioned adjacent the bottom wall 120, such as a driver's license, will be magnified. The lens 128 can be mounted and secured to the clipboard in the recess 122 by various means including snap fitting associated tabs (not shown) on the lens 128 into apertures 130, 132 in side walls 131, 133, respectively.

The lens 128 and the bottom wall 120 are spaced so as to form two rectangular narrow slit openings 142, 146, on the left side and top side, respectively, of the illuminated police ticket clipboard 100. The first 142 of the two rectangular narrow slit openings on the left side of the illuminated police ticket clipboard 100 is a rectangular narrow slit dimensioned commensurate with that of known driver's licenses having information arranged across the wider dimension of the license. The second opening 146 of the two rectangular narrow slit openings at the top of the illuminated police ticket clipboard 100 formed by the lens 128 and the bottom wall 120 is a rectangular narrow slit dimensioned commensurate with that of known driver's licenses having information arranged across the narrower dimension of the license. When a license is slid into the license receiving/viewing device 106, the information on the license can be viewed through the lens 128. If the lens 128 is a magnifier lens, the information on the license is magnified.

Two different illumination sources are provided to illuminate the license receiving/viewing device 106 of the illuminated police ticket clipboard 100 so as to aid in reading information on a driver's license positioned by a clipboard user into one of the rectangular narrow slit openings 142, 146 of the license receiving/viewing device 106. A first license illumination source, including two ultraviolet light sources located in the side walls, respectively, and positioned to direct ultraviolet light toward the recess 122 so as to direct ultraviolet light on a driver's license in the license receiving/viewing device 106. Driver's licenses of certain states have information contained on them that can only be seen when placed under ultraviolet light. This information, not otherwise visible using light in the visible spectrum, is used to show, for example, that the driver's license is authentic and not a forged or fake license. A second light source, such as four incandescent light bulbs, white light sources, or LEDs, are located in the side walls and positioned to direct visible light toward the recess 122 so as to illuminate a driver's license in the license receiving/viewing device 106 to aid in viewing written information on the driver's license.

The words "license" and "card" are used herein to reference any sort of operator's license, ID card, credit or debit card, proof of insurance card, vehicle registration card, permit, order form, or other document which contains some sort of written or graphical information and is sized to be received in the license receiving/viewing device 106 of the illuminated police ticket clipboard 100.

The license information is reviewable by a clipboard user who optionally copies information from the license onto another document or form such as a traffic ticket held in the ticket-writing portion of the clipboard base 102, or onto an accident report held to the outer surface 48 by the document receiving/holding device 46.

The lens 128 is, in accordance with one example embodiment, a magnifier lens that magnifies the license information to facilitate reading of printed information on the license. The ultraviolet light sources and the plurality of visible light sources, when individually turned ON, illuminate the recess 122 from a transverse direction. The lens 128 may optionally be a magnifier lens and combined with the illumination sources to transmit light through the lens 128 for easy reading of the magnified license, or the illumination sources may illuminate the license with light emitted in the transverse direction but not primarily transmitted through the lens 128. Alternatively, the lens 128 could be a transparent cover.

Whether or not the license receiving/viewing device 106 includes a magnifier or transparent cover, the arrangement and dimensions of the sidewalls, the cover, and the bottom wall are such that they hold at least one type of information card depending on the desired use of the clipboard.

In one example embodiment, the license receiving/viewing device 106 includes finger openings 160, 162 to facilitate easy and complete insertion and removal of the license by a user. The user may insert a finger into the appropriate finger openings to urge the license into or out of the license receiving/viewing device 106.

In accordance with one example embodiment, the license receiving/viewing device 106 includes pressure actuated momentary switches 170, 172 that extend up above the bottom wall 120 and are engaged by a leading edge of the license when inserted into the license receiving/viewing device 106. Upon being inserted, the license depresses the associated momentary switch downward, aided by force from the lens 128, in a pinching or compression action. The pressure actuated momentary switches 170, 172 are logically OR'ed so as to control the illumination sources via circuitry, not shown. The inserted license holds the associated pressure actuated momentary switches 170, 172 down until the license is removed. In accordance with one example embodiment, when one of the licenses is first inserted and either switch is activated, only the ultraviolet light sources are turned ON for a predetermined time period, e.g., 2 seconds, and then they are shut off. When the ultraviolet light sources are shut off, the other visible light sources are turned ON and remain ON until the license is removed. This gives the clipboard operator time to view any hidden ultraviolet invisible information on the driver's license prior to viewing the written information.

Optionally, the illuminated police ticket clipboard 100 includes a date, time, and court date information area 108. The court date information area 108 includes at least one of a first date/time display 180 and a second court date display 182. Often, a traffic ticket form provides space for an issuance date and time to be recorded on the ticket, requiring that the issuing officer consult a clock or calendar during issuance of the ticket. The first date/time display 180 is adapted to display at least one of a current date and time so that the issuing officer may quickly ascertain correct issuance information. Furthermore, the illuminated police ticket clipboard 100 optionally includes a second court date display 182 adapted to display at least one of a future time and a future date, referred to herein as the court date. When provided, the future date and future time indicate an appointed court date.

Optionally, the illuminated police ticket clipboard 100 includes a setting device adapted to allow the clipboard user setting of the first date/time display 180. Larger buttons 188 and a setting enable switch 186 are used to set the court date display. The setting enable switch 186 enables and disables the larger buttons 188 so that the court date is not accidentally changed if the larger buttons 188 are bumped, while still preserving the ease of use of the larger buttons in changing the court date as needed since the court date is changed on a frequent basis.

In accordance with one example embodiment, the displays 180, 182 are backlit displays that are backlit when a master power switch (not shown) of the illuminated police ticket clipboard 100 is activated ON. Otherwise, the information on displays 180, 182 can be viewed with reflective light.

The clipboard base 102 optionally further includes the illuminated ticket-writing area 104 having a ticket-holding area 190, which includes a ticket-clip 192 for removably holding a ticket form, or a book of ticket forms, to the clipboard base 102. The ticket-holding area 190 provides support for the ticket while the officer is copying information from the license onto the ticket. The ticket-clip 192 may be of any suitable type to hold the ticket to the clipboard base 102, including but not limited to a spring-loaded clip, a friction clip, an adhesive patch, a transparent cover, a set of posts adapted to mate with holes in the ticket, or the like. The precise nature of the ticket-holding area 190 is not essential to the present invention and may be readily determined for a particular application by one of ordinary skill in the art. Optionally, a ticket-area illumination source 194 is adapted to selectively illuminate the ticket-holding area 190. The ticket-area illumination source 194 includes a plurality of LED's oriented behind a glass or clear plastic cover 195 and is oriented to direct visible light onto the ticket-holding area 190. The LED's of the ticket-area illumination source 194 are turned ON and OFF via control of a master power switch 220 (FIG. 4).

Optionally, the illuminated police ticket clipboard 100 also includes at least one supplemental license receiving/holding area 110 including at least one auxiliary license holding slot 196 adapted to removably hold an auxiliary license to the clipboard base 102. In accordance with one example embodiment, the auxiliary license is held to the clipboard base 102 via channels 202 formed in a recess 204 dimensioned commensurate with a license. The channels 202 optionally are right-angle brackets that form receiving channels 206 to receive and hold the edges of each auxiliary license. Each auxiliary license holding slot 196 may also include at least one spacing rib 208 which spaces or separates the auxiliary license apart from the clipboard base 102 within the auxiliary license holding slot 196. The at least one spacing rib 208 facilitate sliding of the auxiliary license into and out of the auxiliary license holding slot 196.

Optionally, an auxiliary license illumination source 210 is associated with the auxiliary license holding slot 196 and is adapted to selectively illuminate the auxiliary license or other information card placed into the auxiliary license holding slot 196. For example, a pressure switch much like the pressure actuated momentary switches 170, 172 could be used to automatically actuate the auxiliary license illumination source 210 when an auxiliary license is inserted. Optionally, an illumination source switch 212, which may be a slide switch, is used to selectively control the auxiliary license illumination source 210.

Optionally, the master power switch 220 (FIG. 4) simultaneously turns ON and OFF the ticket-area illumination source 194 and auxiliary license illumination source 210 and the backlit function of displays 180, 182. When the master power switch 220 is on, the auxiliary license illuminating source 210 can be controlled by illumination source switch 212. The illuminated police ticket clipboard 100, in one example embodiment, includes rechargeable internal batteries that can be recharged by connection to a vehicle via a plug-in adapter or a wall plug charger arrangement (not shown).

Optionally, a pen/pencil clip is provided on the clipboard base 102 to facilitate attachment of a writing instrument to the illuminated police ticket clipboard 100 for the user's convenience.

FIG. 4 depicts a side view of the illuminated clipboard assembly 10 illustrating the orientation of both the ticket-area illumination source 194 and the license receiving/holding device 106 on the illuminated police ticket clipboard 100 in relation to the removable illumination source 50 on illuminated reporting clipboard 20 once the illuminated reporting clipboard 20 and the illuminated police ticket clipboard 100 are attached together. In this configuration, the user has two writing surfaces oriented roughly 180 degrees from one another and separated by the storage compartment 44 within the illuminated reporting clipboard 20. This allows the user to utilize one side of the illuminated clipboard assembly 10 to, for example, examine license information, and then quickly flip the illuminated clipboard assembly 10 over to the other side to view (or fill out) any necessary documentation relating to the particular encounter (e.g., accident reporting). The removable illumination source 50 can quickly be stored in compartment 44 or reattached for multi-tasking and day/night use.

From the above description of the invention, those skilled in the art will perceive improvements, changes and modifications in the invention. Such improvements, changes and modifications within the skill of the art are intended to be covered by the appended claims.

Having described the invention, the following is claimed:

1. An illuminated clipboard, comprising:

a base member having a bottom side and a plurality of sidewalls extending from the bottom side, the sidewalls and the bottom side defining a cavity with an open top;

a top member hingedly coupled to the base member to close the open top of the cavity;

a first lamp retainer attached to a first side of the top member opposite the base member, and including a plurality of spaced apart mounting posts extending from the first side of the top member;

a storage compartment formed within the cavity, a second lamp retainer disposed inside the storage compartment, said second lamp retainer being identical to said first lamp retainer:

a document holder clip secured to said top member for holding a document; and an illumination source having a housing, at least one light emitting element, at least one battery and a switch for selectively connecting the light emitting element to the battery, the housing including a plurality of spaced apart receiving openings configured to receive the plurality of mounting posts of either one of the first and second lamp retainers, such that said illumination source is removably attachable to the first lamp retainer to selectively illuminate a document held by the document holder clip and removably attachable to the second lamp retainer for storage in the storage compartment.

2. The illuminated clipboard of claim 1, wherein said housing is a rigid housing.

3. The illuminated clipboard of claim 1, wherein said battery is a rechargeable battery.

4. The illuminated clipboard of claim 1 further comprising a hinge for connecting a top portion and a bottom portion of said storage compartment.

5. The illuminated clipboard of claim 1 wherein the illuminated clipboard is comprised of a member selected from the group consisting of plastic, wood, chipboard, cardboard, and metal.

6. The illuminated clipboard of claim 1 wherein the illuminated clipboard is comprised of plastic.

7. The illuminated clipboard of claim 1 wherein the illuminated clipboard is comprised of metal.

8. The illuminated clipboard of claim 1 which is further comprised of a clasp which is internal to the storage compartment and which maintains the top member and the base member in a normally closed position.

9. The illuminated clipboard of claim 1 wherein the top member is hingeably coupled to the base member by a piano hinge.

10. The illuminated clipboard of claim 1 wherein the storage compartment is further comprised of an internal seal to make the storage compartment waterproof.

11. The illuminated clipboard of claim 1 wherein the document holder clip is a spring-loaded clip.

12. The illuminated clipboard of claim 1 wherein the document holder clip is a friction clip.

13. The illuminated clipboard of claim 1 wherein the mounting posts are rectangular.

14. The illuminated clipboard of claim 1 wherein the illumination source is a plurality of light emitting diodes.

15. The clipboard assembly comprising:

the illuminated clipboard of claim 1 and a second clipboard wherein the illuminated clipboard and a second clipboard are reversibly secured together in an operative back to back relationship.

16. The clipboard assembly of claim 15 wherein the second clipboard includes a source of illumination.

17. The illuminated clipboard of claim 1 further comprising a detachable clipboard and an attachment device to releasably secure the illuminated clipboard to the detachable clipboard.

18. The illuminated clipboard of claim 17, wherein said attachment device includes at least one hook and loop fastener strip.

19. The illuminated clipboard of claim 17, wherein said attachment device includes double-sided adhesive tape.

* * * * *